United States Patent [19]

Sanders et al.

[11] Patent Number: 4,678,171

[45] Date of Patent: Jul. 7, 1987

[54] POSITIONING LIFT FOR SURGICAL TABLE

[75] Inventors: Ward L. Sanders; David W. Robinson, both of Erie, Pa.

[73] Assignee: American Sterilizer Company, Erie, Pa.

[21] Appl. No.: 746,411

[22] Filed: Jun. 19, 1985

[51] Int. Cl.[4] ..... A61G 13/00

[52] U.S. Cl. ..... 269/325

[58] Field of Search ..... 128/69–72; 269/322–328; 5/432–433; 108/3

[56] References Cited

U.S. PATENT DOCUMENTS

| | | | |
|---|---|---|---|
| 86,604 | 2/1869 | Taylor | 128/70 |
| 859,696 | 7/1907 | Schmidt | 269/325 |
| 912,588 | 2/1909 | Marseilles | 128/70 |
| 1,459,953 | 6/1923 | Freise | 128/72 |
| 1,470,362 | 10/1923 | Hawley | 128/71 |
| 2,193,882 | 3/1940 | Petersen | 128/70 |
| 2,904,039 | 9/1959 | Weissenberg | 128/69 |
| 3,206,188 | 9/1965 | Douglass | 269/325 |
| 3,334,951 | 8/1967 | Douglass | 269/328 |
| 4,176,415 | 12/1979 | Dickerson et al. | 5/433 |

FOREIGN PATENT DOCUMENTS

| | | | |
|---|---|---|---|
| 379055 | 8/1964 | Switzerland | 128/72 |

*Primary Examiner*—Robert C. Watson

*Attorney, Agent, or Firm*—Robert D. Yeager; George D. Dickos

[57] ABSTRACT

A movable member mounted in an opening in the back support section of a multisectioned surgical table. The movable member is so pivotally connected to a portion of the perimeter of the opening that the movable member can assume a range of articulated positions relative to the back section for lifting portions of the patient's body. The movable member has contoured edges for providing a smooth, preferably padded surface against which the portions of the patient's body can be supported and restrained against lateral rolling. The edges of the movable member are preferably also contoured to define a perineal cutout. Means are provided for locking the movable member into selective positions within the range of articulated positions.

14 Claims, 10 Drawing Figures

POSITIONING LIFT FOR SURGICAL TABLE

BACKGROUND OF THE INVENTION

1. Field of the Invention

The present invention relates to multisectioned surgical tables, and more particularly to a surgical table having a movable section mounted in the back section of the patient support surface for positioning portions of the patient's body.

2. Description of the Prior Art

Conventional surgical tables have multisectioned patient support surfaces which can be articulated to provide a range of positions relative to each other for anatomically posturing a patient's body according to the surgical procedure to be performed. A five-sectioned surgical table is available which includes a head section, a back section, a lumbar section, a femoral section and a foot section. The lumbar section is advantageous in enhancing the range of anatomical contours the table surface can assume. For example, the lumbar section provides added support and lifting capability for the patient's lower abdominal, pelvic and lumbar regions. Five-sectioned surgical tables are, however, more complicated to manufacture, and therefore, more costly to the purchaser.

Four-sectioned surgical tables are also available; these tables have a larger back section, eliminating the separate lumbar section. The four-sectioned surgical tables are less costly but do not provide the positioning capabilities of the five-sectioned tables which include the lumbar section.

Accessories, such as separate kidney bridges and pelvic rests, can be used with the four-sectioned tables to improve anatomical posturing. U.S. Pat. Nos. 859,696; 870,324; 2,926,660 and 4,398,707 disclose means for supporting the abdomen, pelvis or lumbar regions of a patient but, because they are static devices, fall short of providing the range of positioning capabilities afforded by the five-sectioned table with an articulating lumbar section. The means disclosed in U.S. Pat. No. 2,926,660 is movable along a vertical axis but does not provide the variety of anatomical contours required by some surgical procedures.

Accordingly, there is a need for a device which will provide a range of adjustable positions for supporting the pelvic, lumbar and abdominal portions of a patient's body, without the complexity of structure which contributes to increased costs. There is a further need for such a device which can be integrally incorporated into a surgical table having a back section and at least one adjacent pivoting section.

SUMMARY OF THE INVENTION

The present invention provides an improvement in surgical tables having multi-sectioned patient support surfaces which enhances the anatomical posturing capability of the table while reducing the number of sections necessary. The present invention can also enhance the posturing capability of a single-sectioned table having accessories such as leg boards or stirrups, for supporting at least a portion of a patient's lower extremities.

In a surgical table having a multisectioned patient support surface, including a back section for supporting the patient's back and at least one adjacent section, each of the sections being so pivotally movable relative to its adjacent sections that the table surface can assume a range of positions for anatomically posturing the patient's body for different surgical procedures, the improvement of the present invention includes an opening defined in the back section, the opening having a perimeter, and a movable member mounted in the opening and being so pivotally connected to a portion of the perimeter that the movable member can assume a range of articulated positions relative to the back section for lifting portions of the patient's body. The particular position within the range of articulated positions is selectively independent of the contour of the table surface. The movable member has contoured transverse edges for providing a smooth, preferably padded, surface against which the portions of the patient's body can be supported and restrained against lateral rolling. The improvement also includes means for locking the movable member into a selected position within the range of articulated positions.

The improvement may also include means for coordinating the articulated position of the movable member with the contour assumed by the table surface. The transverse edges of the movable section may also be further contoured to define a perineal cutout.

The movable member of the present invention can be positioned relative to the back section of the surgical table to provide the pelvis and lumbar spine of the patient with support for a lithotomy posture, wherein the perineal cutout provides access for surgical procedures; or to provide the pelvic stabilty for knee/chest procedures; or to provide a kidney lift patient posture for thoracic and kidney flex procedures.

In the preferred embodiment, the movable member is used with a surgical table having a patient support surface which includes a head support section, a back support section adjacent the head section, a femoral support section adjacent the back section, and a foot support section adjacent the femoral section. The opening has a first perimeter edge proximal of the head section. The movable member may be pivotally mounted to the first edge.

Other details and advantages of the present invention will become apparent from a consideration of the following detailed description, taken with the accompanying drawings in which:

DETAILED DESCRIPTION OF THE PREFERRED EMBODIMENTS

Figure 1:
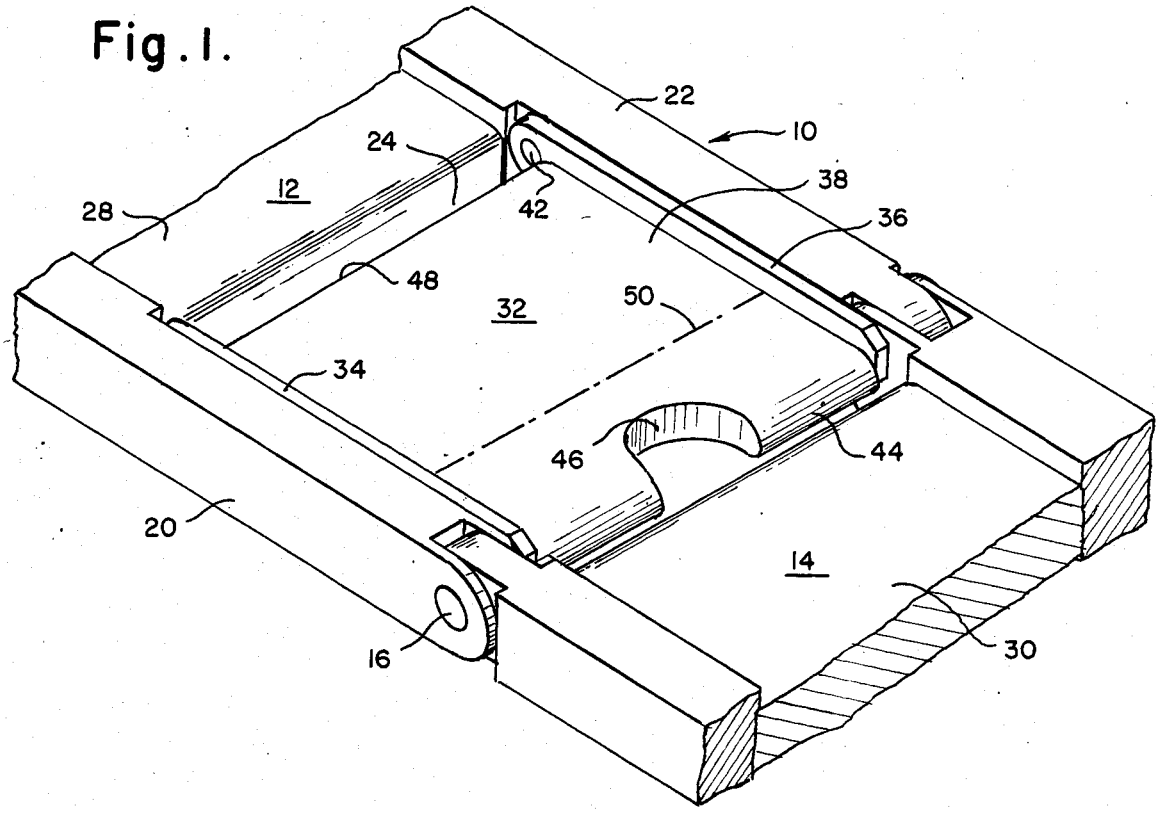
FIG. 1 is a fragmentary perspective view of a surgical table including one embodiment of the present invention.
Figure 2:
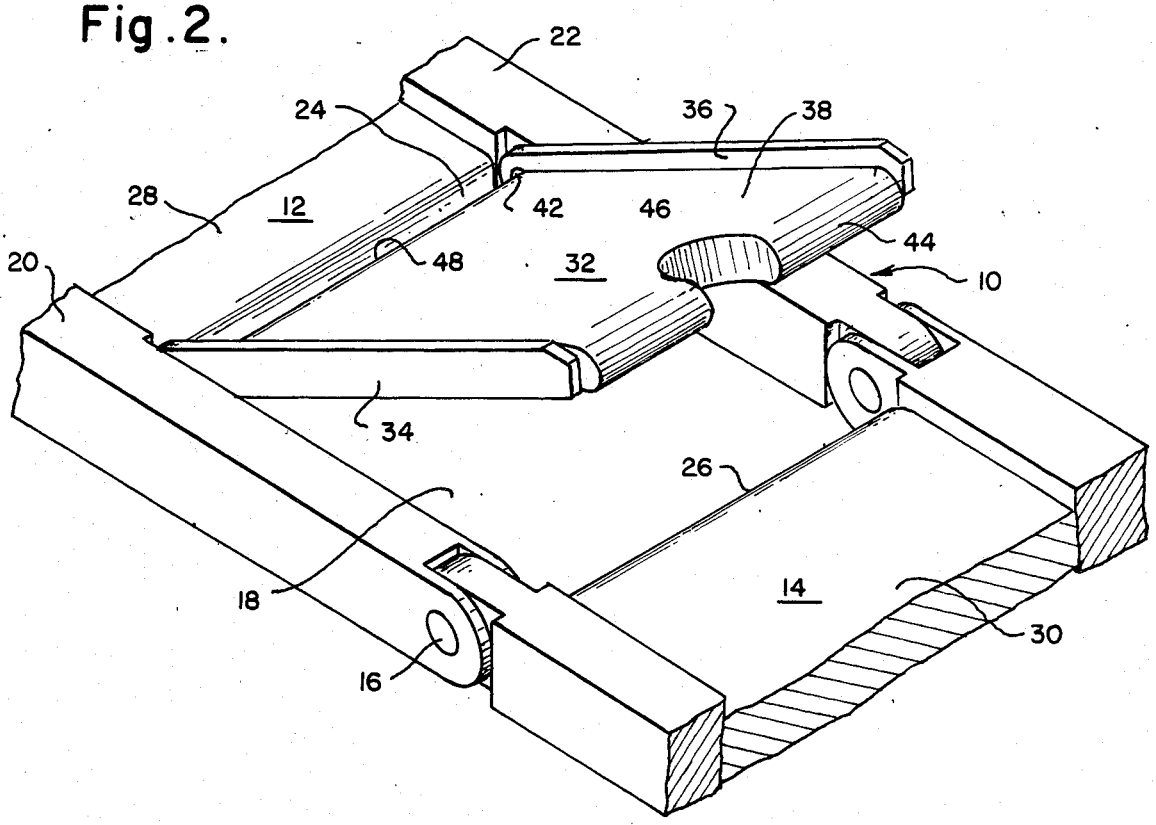
FIG. 2 is a view similar to FIG. 1 showing the movable member of the present invention inclined with respect to the surgical table.
Figure 3:
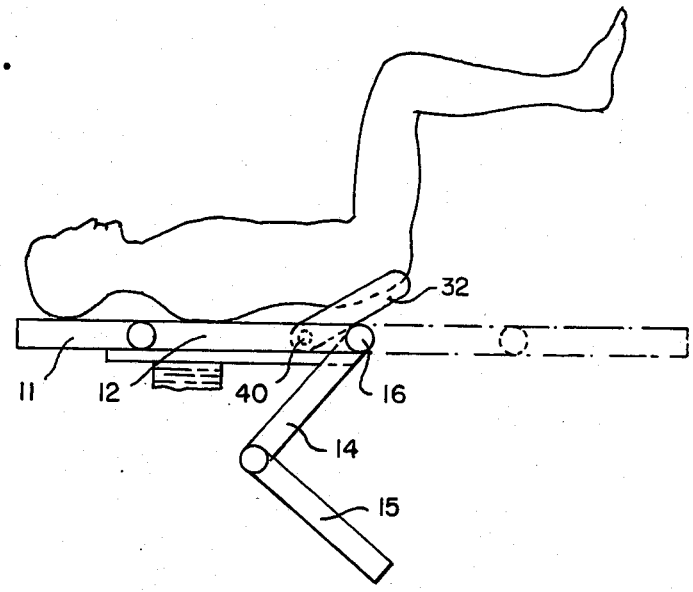
FIG. 3 is a side elevational view showing a surgical table embodying the present invention with a patient manipulated to the lithotomy posture.
Figure 4:
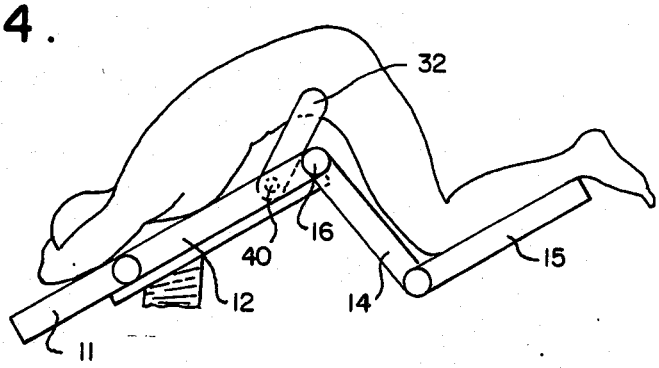
FIG. 4 is a side elevational view showing a surgical table embodying the present invention with a patient manipulated to the knee/chest posture.
Figure 5:
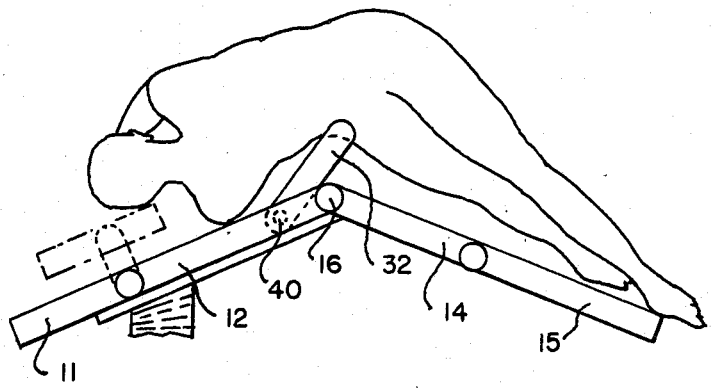
FIG. 5 is a side elevational view of surgical table embodying the present invention with a patient manipulated to the thoracic/kidney flex posture.

Referring to the drawings, particularly to FIGS. 1 and 2, there is shown a portion of a surgical table top 10 having four movable sections (as shown in FIGS. 3–5); only a part of the back section 12 and the femural section 14 are shown. As with all juxtaposed sections of surgical table top 10, back section 12 is pivotally connected to femural section 14 by conventional means at 16 to permit independent pivotal movement of each section 12, 14 about the transverse axis forming the connection therebetween.

Back section 12 includes an opening 18 (see FIG. 2) bounded longitudinally by side rails 20 and 22, and by the facing edges 24 and 26 of patient supporting surfaces 28 and 30, respectively, of back section 12 and femural section 14. Opening 18 may have a perimeter somewhat smaller than that shown in FIGS. 1 and 2 wherein the longitudinal sides may be portions of the back section 12 and the transverse sides may also be a portion of back section 12, rather than the facing edge 26 of femural section 14.

Pivotally mounted within opening 18 on a transverse axis is a movable patient supporting member 32. Movable member 32 includes a support surface 38 positioned between two side members 34 and 36. The side members 34, 36 are pivotally connected at 40, 42 respectively, to side rails 20, 22 of back section 12.

The support surface 38 of movable member 32 has a transverse edge 48 adjacent facing edge 24 and a contoured edge 44 which preferably includes a perineal cutout 46. Contoured edge 44 can be removed by separating the edge along line 50 (see FIG. 1) and sliding it along tracks (not shown) on the inside of side members 34 and 36. The edge 44 can be replaced with an accessory edge having a different contour suitable for different surgical procedures. Alternatively, a variety of support surfaces 38 having differently contoured edges 44 can be inserted between side members 34 and 36. The contoured edges 44 provide a smooth surface against which the portions of the patient's body can be supported. Preferably, the contours restrain the patient against lateral rolling. Additional padding may be provided for the patient's comfort.

Any suitable means for moving movable member 32 about the transverse axis between pivots points 40 and 42 can be used. The mechanism employed to position the multisectioned table can be used to position the movable member. Further, any suitable means for locking the movable member 32 into a selected position within a range of articulated positions can be used. If a motorized gear system or a fluid powered cylinder system is used, the movable member 32 can be self-locking. When the power is shut off upon attainment of a desired position, no further movement will occur. The locking means may, however, be manually operated by latches, braces or similar mechanical means.

Preferably, the articulated positions of movable member 32 are coordinated with the assumption of positions by the table top 10. The movable member 32 can assume a variety of positions within a range of articulated positions; the range, for safety consideration, being in the vicinity of 30°. However, in particular surgical procedures, such as juvenile neurosurgery, the movable member 32 can assume the position of a seat, 90° relative to the plane of the table top 10. Any degree of articulation can be achieved, and the desired range may depend on the types of procedures to be performed.

For example, FIG. 3 illustrates the lithotomy position. The movable member 32 lifts the patient's pelvis and lumbar spine. The patient's head and back are supported by head section 11 and back section 12. Femural section 14 and foot section 15 are bent out of the way. The perineal cutout 46 provides easy access to perineal operative sites.

FIG. 4 illustrates a knee/chest position wherein the movable member 32 provides preferred support for lumbar laminectomy and proctology procedures. The movable member 32 supports and levels the lumbar area and provides freedom beneath the abdominal and chest areas for improved respiration. The patient's weight is evenly distributed between the knees on foot section 15 and the iliac crest. To accommodate different femur lengths, movable member 32 can be adjusted to assure even weight distribution, regardless of the size of a particular patient. The movable member 32 can substitute for the Morgan Pelvic rest.

The thoracic/kidney flex position is illustrated in FIG. 5. Movable member 32 can be raised independently of the table top sections 11, 12, 14 and 15, or moved in conjunction with those sections in a coordinated manner. The movable member 32 lifts the patient at the preferred point to tilt the pelvis and expand the opposite intercoastal dimension. The contour and padding of edge 44 provides a comfortable lift and restrains the patient against lateral rolling. Physiological damage is minimized and excellent exposure to the kidney and thoracic regions is provided. Those skilled in the art will recognize that other patient postures and combinations of table top 10 and movable member 32 positions can be easily achieved.

Figure 6:
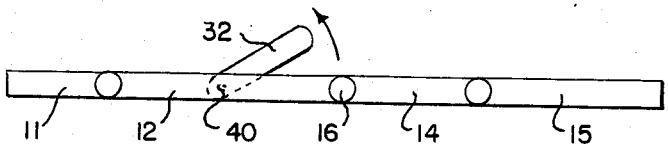
FIGS. 6–10 are diagrammatic views of a surgical table embodying the present invention in a number of ways to achieve a variety of lift geometries.
Figure 7:
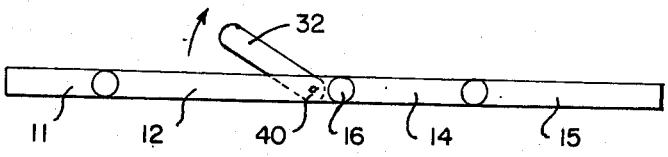

The exact location of the pivot points 40, 42 depend on the design of the table top 10 and its intended use. FIG. 6 illustrates schematically the arrangement shown in FIGS. 1 through 5. FIG. 7 illustrates an alternative arrangement wherein pivot points 40, 42 are located adjacent facing edge 26 rather than facing edge 24. As the arrow indicates, the direction of movement is opposite that shown in FIG. 6.

Figure 8:
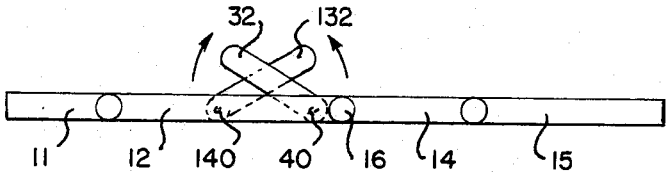

FIG. 8 illustrates yet another alternative. There may be two movable members 32 and 132 which pivot respectively, in opposite directions about points 40, 42 and 140, 142. Member 132 may be positioned within an enlarged cutout in the center of member 32 or may be positioned beside a member 32 which has been halved longitudinally; members 32 and 132 combining to provide the same surface area provided by the member 32 of FIGS. 1 through 5. The arrangement shown in FIG. 8 provides lift support at two points.

Figure 9:
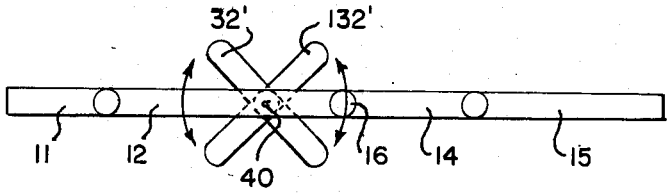
Figure 10:
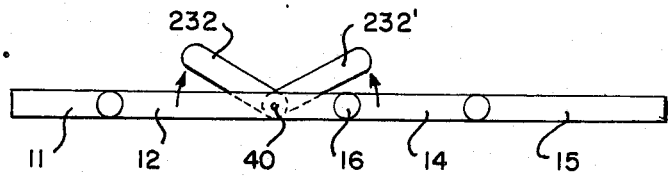

FIG. 9 and 10 illustrate arrangements which also provide lift support at two points. The members 32' and 132' of FIG. 9 each pivot in any direction about the transverse axis defined between pivot points 40 and 42. As with the members 32 and 132 of FIG. 8, members 32' and 132' may be positioned, one within a cutout region of the other, or side by side. There may also be two such members 32' and 132' each being the full width of the opening 18, but limited in their range of articulation relative to each other.

FIG. 10 illustrates an embodiment of movable member 32 which includes two halves 232 and 232' which pivot independently of each other in opposite directions about the transverse axis defined between pivot points 40 and 42.

Movable member 32 can optionally be made of any suitable radio transparent material to accommodate x-ray apparatus or related auxiliary apparatus.

The movable member 32 extends the positioning capabilty of a table top having four or fewer sections. The member 32 may be used with a single section table, such as an examining table, having leg board or stirrup accessories to support at least a portion of the patient's lower extremities. A four sectioned table with the movable member 32, achieves the positioning capabilities of a five sectioned table having a lumbar section between the back and femural sections, without the accompanying cost. In addition, the movable member 32 combines in one integral device the positioning functions of some conventionally used accessories, such as the kidney bridge and the pelvic rest.

What is claimed is:

1. In a surgical table having a multisectioned patient support surface including a back section for supporting the patient's back and at least one adjacent section, each of the sections being so pivotally movable relative to the adjacent sections that the table surface can assume a range of positions for anatomically posturing portions of the patient's body for different surgical procedures, the improvement comprising:

the back section defining an opening therein, said opening having a perimeter;

a movable member mounted in said opening and being so pivotally connected to a portion of said perimeter that said movable member can assume a range of articulated positions relative to the back section for lifting portions of the patient's body, the assumption of said positions within said range of articulated positions being selectively independent of the assumption of positions by the table surface; and means for locking said movable member into selective positions within said range of articulated positions.

2. The improvement recited in claim 1 wherein said movable member has contoured edges for providing a smooth surface against which the portions of the patient's body can be supported and restrained against lateral rolling.

3. The improvement recited in claim 2 wherein said edges are further contoured to define a perineal cutout.

4. improvement recited in claim 3 wherein said movable member can be positioned relative to the back section to provide the pelvic and lumbar portions of the patient's back with support for lithotomy table postures, said perineal cutout providing access for the surgical procedure.

5. The improvement recited in claim 1 wherein said movable member is padded for comfortable patient support.

6. The improvement recited in claim 1 wherein said movable member can be positioned relative to the back section to provide a kidney lift for thoracic and kidney flex table postures.

7. The improvement recited in claim 1 wherein said movable member can be positioned relative to the back section to provide the pelvic portion of the patient's abdomen with support for knee/chest table postures.

8. The improvement recited in claim 1 further providing means for coordinating the articulated position of said movable member with the assumption of positions by the table surface.

9. A surgical table for anatomically posturing portions of a patient's body for different surgical procedures comprising:

a multisectioned patient support surface, each of said sections being so pivotally movable relative to the other sections that said surface can assume a range of positions for anatomically posturing portions of the patient's body;

means for pivoting each of said sections relative to each other;

one of said sections defining an opening therein, said opening extending substantially transverse of said one section and having a perimeter;

a movable member mounted in said opening and being so pivotally connected to a portion of said perimeter that said movable member can assume a range of positions relative to said one section for lifting portions of the patient's body, the assumption of said positions within said range of positions being selectively independent of the assumption of positions by said patient support surface, said movable member being contoured for providing a smooth surface against which the portions of the patient's body can be supported; and means for locking said movable member into selective positions within said range of positions.

10. The table recited in claim 9 wherein said movable member is contoured to restrain the patent against lateral rolling.

11. The table recited in claim 9 wherein said movable member is further contoured to define a perineal cutout and padded for comfortable patient support.

12. The table recited in claim 11 wherein said movable member can be positioned relative to said back section to selectively provide the pelvic and lumbar portions of the patient's back with support for lithotomy surface positions, said perineal cutout providing access for surgical procedures, the pelvic portion of the patient's abdomen with support for knee/chest surface positions, and a kidney lift for thoracic and kidney flex surface positions.

13. In an examining table having a patient support surface and one end adapted for releasable attachment to members for supporting at least a portion of a patient's lower extremities, the improvement comprising:

said surface defining an opening therein proximate said one end of said table, said opening having a perimeter;

a movable member mounted in said opening and being pivotally connected to a portion of said perimeter for assuming a range of positions relative to said surface for lifting portions of the patient's body; and means for locking said movable member into selective positions within said range of positions.

14. The improvement recited in claim 13 wherein said movable member has contoured edges for providing a smooth surface against which the portions of the patient's body can be supported and restrained against lateral rolling.

* * * * *